United States Patent [19]

Sano

[11] 4,182,944

[45] Jan. 8, 1980

[54] TOGGLE SWITCH WITH A LIGHT EMITTING DIODE ELEMENT ATTACHED TO THE TOP END OF A KNOB

[75] Inventor: Minoru Sano, Yokosuka, Japan

[73] Assignee: Fujisoku Electric Co., Ltd., Kawasaki, Japan

[21] Appl. No.: 910,287

[22] Filed: May 30, 1978

[30] Foreign Application Priority Data

| | | | |
|---|---|---|---|
| Jun. 2, 1977 | [JP] | Japan | 52/71714[U] |
| Jun. 2, 1977 | [JP] | Japan | 52/71715[U] |
| Aug. 30, 1977 | [JP] | Japan | 52/115888[U] |

[51] Int. Cl.[2] ..... H01H 9/16; H01H 1/20; H01H 3/04

[52] U.S. Cl. ..... 200/315; 200/153 G; 200/243

[58] Field of Search ..... 200/313, 314, 315, 316, 200/153 G, 243; 116/124 L

[56] References Cited

U.S. PATENT DOCUMENTS

| | | | |
|---|---|---|---|
| 3,614,362 | 10/1971 | Keranen | 200/315 |
| 4,055,739 | 10/1977 | Piber | 200/315 |

FOREIGN PATENT DOCUMENTS

| | | | |
|---|---|---|---|
| 1293886 | 4/1969 | Fed. Rep. of Germany | 200/315 |
| 2360737 | 6/1975 | Fed. Rep. of Germany | 200/315 |
| 1428289 | 1/1966 | France | 200/315 |
| 42-3896 | 3/1967 | Japan | 200/315 |
| 47-12478 | 10/1972 | Japan | 200/315 |
| 51-11649 | 3/1976 | Japan | 200/315 |

*Primary Examiner*—Richard R. Stearns
*Attorney, Agent, or Firm*—Frishauf, Holtz, Goodman and Woodward

[57] ABSTRACT

A toggle switch has a light emitting diode element (LED) attached to the top end of a knob. The other end of the knob is attached to a rockable member which is supported by a case to be turnable within a predetermined angle. Two lead wires of the LED are inserted, respectively, into two holes in an insulating plastic spring holder fitted in the knob, through one-end openings of the two holes which extend along the axial direction of the spring holder and open at the other end of the knob. A conductive metal coil spring is contained in each hole and each lead wire is inserted into and electrically contacted with its corresponding coil spring at many places. The other opening of the hole is located in the vicinity of the rocking center of the rockable member, at which area is also located a pair of conductive metal terminals for power supply. A conductive metal connecting bar is attached to the end of each coil spring contained in each said hole, and is spring-biased to bear against its corresponding terminal, the coil spring and terminal being securely electrically connected with each other by means of the bar.

8 Claims, 10 Drawing Figures

TOGGLE SWITCH WITH A LIGHT EMITTING DIODE ELEMENT ATTACHED TO THE TOP END OF A KNOB

BACKGROUND OF THE INVENTION

This invention relates to a toggle switch provided with an LED (light emitting diode) element, and more specifically to a toggle switch with an LED attached to the top end of a knob.

There have conventionally been developed various types of toggle switches with a light source. These toggle switches may be classified into two types according to their light sources used; miniature incandescent lamps and light emitting diode elements. Since even the smallest incandescent lamp may be substantially larger than any light emitting diode element, a toggle switch using such incandescent lamp will become larger as a whole. Further, the incandescent lamp consumes more electric power as compared with the light emitting diode element though the former can provide more sufficient illuminance than the latter. The light source only requires enough illumination to indicate the position of switch as well as completion of switching, and should have a low power consumption. Accordingly, the light emitting diode is preferred to the miniature incandescent lamp as a light source attached to the toggle switch.

Classifying the toggle switch with a light source according to the position at which the light source is attached, there are two types; toggle switches with a light source attached to a case or panel and toggle switches with a light source attached to the top end of a knob. Although with a simple construction, the toggle switch with the light source attached to the case needs a larger case because the case requires a light source mounting section, failing clearly to indicate the position of the knob. As for the toggle switch with the light source attached to the top end of the knob, it can clearly indicate the knob position and completion of switching, with substantially the same size as that of any switch without a light source. In this type of toggle switch, however, the light source is attached to a rockable knob, and the light source must be securely electrically connected with terminals fixed to the case, so that its construction may be complicated and considered unfit for mass production.

SUMMARY OF THE INVENTION

An object of this invention is to provide a compact toggle switch with an LED attached to the top end of a knob which is fit for mass production.

Another object of the invention is to provide a toggle switch capable of easy manufacture and assembly in which a pair of lead wires of an LED element attached to the top end of a rockable knob are securely electrically connected with a pair of terminals fixed to a case.

According to the invention, there is provided a toggle switch comprising a light emitting diode element having at least two lead wires for power supply and provided with a base from which the lead wires are extended and a light emitting portion mounted on the base; a cylindrical knob receiving the light emitting diode element, the light emitting portion of the light emitting diode element being exposed through one end of the knob; an elongated electrically insulating spring holder having at least two long and narrow holes extending along the axial direction thereof and into which the lead wires of the light emitting diode element are separately inserted through one-end openings thereof, and spring stoppers formed in each of the holes in close vicinity to the one-end openings, and fitted in the knob; conductive metal spring members contained in each of the holes of the spring holder, having one end brought in contact with each of the spring stoppers, and being in contact at many places with the lead wires inserted in the holes; a rockable member fitted with the other end of the knob and capable of being rocked within a predetermined angle by operating the knob; a case for rockably supporting the rockable member; a common terminal and two switching terminals made of a conductive metal, fixed to the case, and extending out from the case; a conductive metal movable contact mounted on the ends of the terminals inside the case and being always in contact with the common terminal as well as with either of the two switching terminals; a spring-biased rod with one end held by the rockable member and the other end spring-biased to bear against the movable contact, the other end sliding on the movable contact in response to a turn of the rockable member to switch the movable contact from one switching terminal to the other switching terminal; and at least two conductive metal power supply terminals fixed to the case and each having one end substantially in alignment with the center of rocking of the rockable member inside the case, located in close proximity to the other-end opening of each hole of the holder, and electrically connected with the other end of each spring member contained in the hole, and the other end of each power supply terminal extending outside the case.

DETAILED DESCRIPTION OF THE PREFERRED EMBODIMENT

Figure 1:
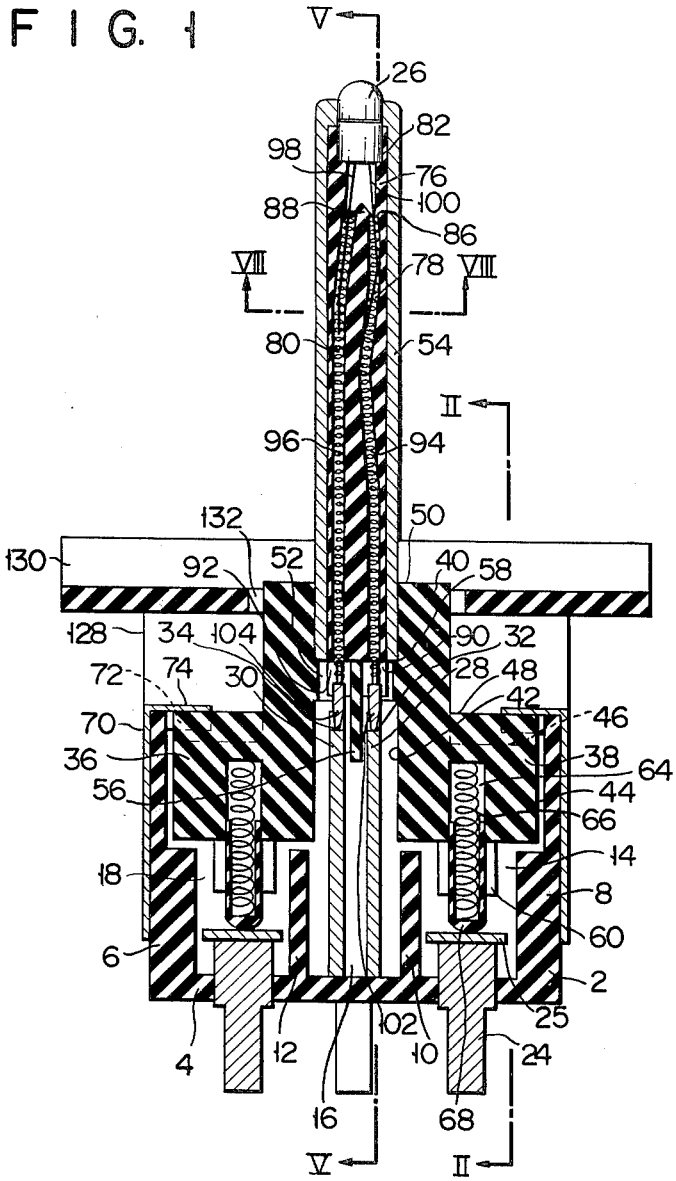
FIG. 1 is a profile of the toggle switch according to an embodiment of this invention.
Figure 2:
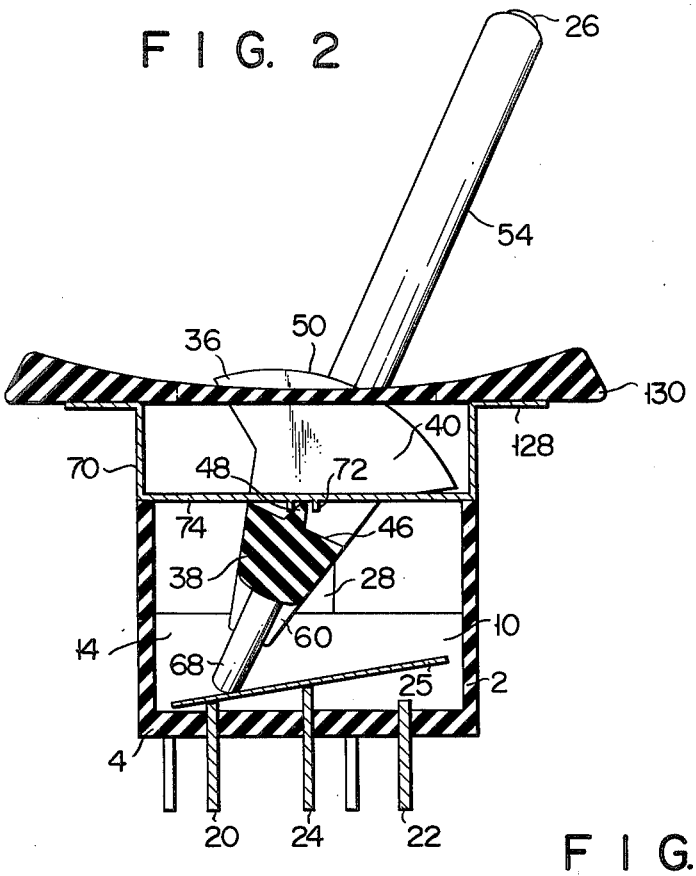
FIG. 2 is a sectional view as taken along line II—II of FIG. 1.

Referring now to FIG. 1, there is shown the toggle switch according to an embodiment of the invention which is provided with a boxlike case 2 made of an electrically insulating plastic material. The lower space inside the case 2 is divided into three chambers, first, second and third chambers 14, 16 and 18, by means of two partition walls 10 and 12 extending from a bottom portion 4 of the case 2 to the middle of side portions 6 and 8. Into each of the first and third chambers 14 and 18 projects each one-end portion of plate-like first and second switching terminals 20 and 22 and a common terminal 24 fixed to the bottom portion 4 of the case 2, as shown in FIG. 2. These three terminals 20, 22 and 24 are disposed in parallel with one another at regular intervals, the respective other ends thereof protruding out of the case 2. The one-end portions of the switching terminals 20 and 22 are at an equal height, whereas one end of the common terminal 24 disposed between extends higher than the ends of the terminals 20 and 22. A conductive movable contact 25 is mounted on these ends of the switching terminals 20, 22 and 24. Disposed in the second chamber 16 are a pair of plate-like terminals 28 and 30 for supplying electric power to a light emitting diode element 26 (hereinafter referred to simply as LED element), the terminals 28 and 30 being fixed to the bottom portion 4 and having one end extending to the opening portion of the case 2. The other ends of the terminals 28 and 30, like those of the terminals 20, 22 and 24, protrude out of the case 2. Moreover, recesses 32 and 34 are formed on these other ends of the terminals 28 and 30 respectively.

Figure 3:
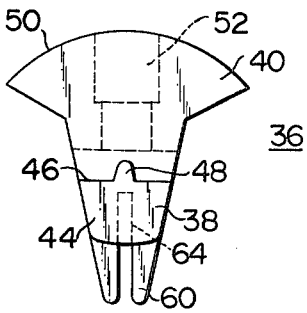
FIGS. 3 and 4 are side and front views of a rockable member included in the toggle switch of FIG. 1, respectively.
Figure 4:
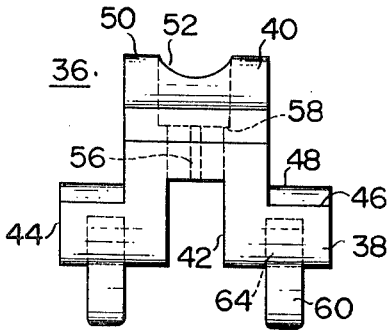

A pair of block sections 38 of a rockable member 36 are contained in the upper space inside the case 2, and a sector section 40 is disposed out side the opening portion of the case 2. The rockable member 36 is integrally, bisymmetrically made of an insulating material such as plastic, as shown in FIGS. 3 and 4. The pair of block sections 38 of the rockable member 36 are formed integral with the bottom of the sector section 40 with a space between the pair of block sections. The space between opposite inside faces 42 of the block sections 38 is wide enough to allow the other ends of the pair of terminals 28 and 30 to be arranged in that space, while the space between outside faces 44 of the block section 38 is equal to or a little narrower than the width inside the case 2. Disposed on a shoulder portion 46 formed on the top of each of the block sections 38 is provided with a projection 48, the top end of which is alignment with the central axis of rocking of the rockable member 36. Bored through the sector section 40 is a through hole 52 extending from a curved surface 50 of the sector section 40 to the space between the block sections 38. The inside diameter of the hole 52 is made equal to or a little smaller than the outside diameter of the bottom end of a knob 54 so as to facilitate forcing the bottom end of the knob 54 into the hole 52. The hole 52 is provided with a plate-like stopper 56 with which the bottom end of the knob 54 inserted in the hole is brought in contact, as well as a stepped portion 58 with reduced inside diameter with which the bottom end of the knob 54 is also brought in contact. From each bottom face of the block sections 38 extend a pair of fingers 60. Bored in each block section 38 is a hole 64 which opens between the fingers 60 to receive a coil spring 66. As shown in FIGS. 1 and 2, inserted in the spring hole 64, are the spring 66 and a spring-biased sliding rod 68 which is pushed against the movable contact 25.

The opening of the case 2 is provided with a frame 70 fixed to the case 2. The frame 70 is provided with support lugs 72 for pivotally supporting the projections 48. These support lugs 72 are formed on a flange portion 74 of the frame 70 in alignment with the center of rocking of the rockable member 36. Since the rockable member 36 is thrust upward by the spring 66, the projection 48 is pushed against its corresponding support lug 72. The sector section 40 protrudes from the opening of the case covered with the flange portion 74 of the frame 70, the opening portion restricted by the flange portion 74 being defined shorter than the longitudinal length of the sector section 40. Therefore, the bottom portion of the sector section 40 hits or bears against the flange portion 74 when the rockable member 36 is turned, so that the turn of the rockable member 36 is limited within a fixed angle.

Figure 5:
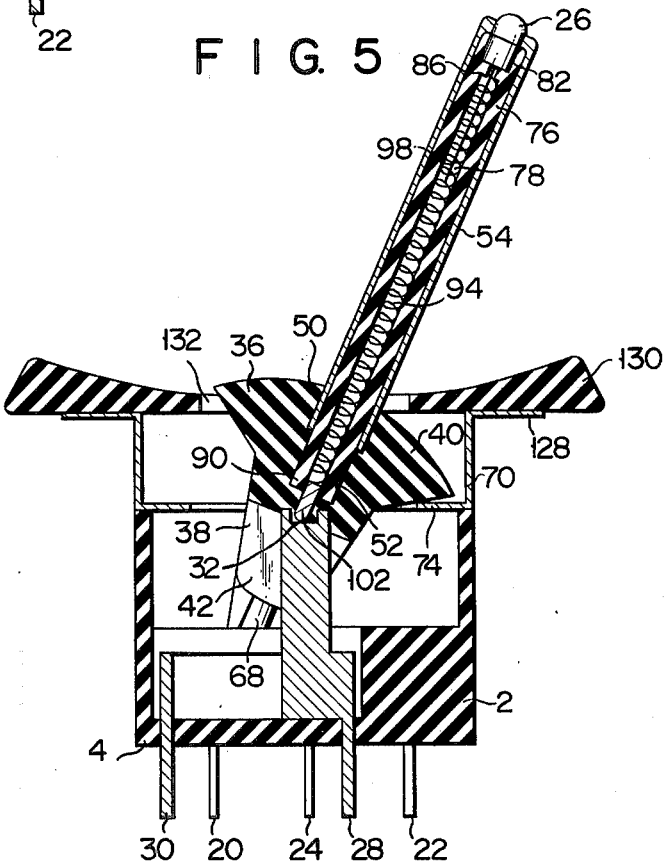
FIG. 5 is a sectional view as taken along line V—V of FIG. 1.

As shown in FIGS. 1 and 5, the knob 54 fitted in the hole 52 of the sector section 40 is formed of a metallic cylinder, in which a substantially cylindrical spring holder 76 made of an insulating plastic material is fitted. The light emitting portion of the LED element 26 is exposed from the top end opening of the knob 54. Formed in the spring holder 76 are a pair of guide holes 78 and 80 for containing springs, at least one of the guide holes extending windingly along the axial direction. A recess 82 for receiving the base of the LED element 26 is formed at one end portion of the spring holder 76 where the guide holes 78 and 80 open. Further, provided at the opening portions of the guide holes 78 and 80 are spring stoppers 86 and 88 which are formed by narrowing the openings of the holes 78 and 80 so as to prevent the one-side ends of springs 94 and 96 contained respectively in the holes 78 and 80 from flying out into the recess 82. Two sets of legs 90 and 92 extend from the respective peripheral edges of the guide holes 78 and 80 at the other end portion of the spring holder 76. The conductive coil springs 94 and 96 are inserted in the guide holes 78 and 80 of the spring holder 76, respectively. As the hole 78 is curved, the coil spring 94 inserted therein is also curved, as shown in FIG. 1. A pair of lead wires 98 and 100 fixed to the base of the LED element 26 and extending from the base are inserted in the guide holes 78 and 80, and brought in contact at many places with the coil springs 94 and 96 contained in the holes 78 and 80, respectively. As a result, the lead wires and the coil springs are securely electrically connected with each other. The lead wire 98 of the LED element 26 inserted in the curved hole 78 is also curved, hitting against the curved wall of the hole 78. The coil spring 94 and the lead wire 98 contained and inserted in the hole 78 are brought in closer contact and more securely electrically connected with each other because the coil spring 94 and the lead wire 98 are transformed by guide hole 78 and the degrees of transformation of the coil spring 94 and the lead wire 98 are different. The space between the pair of guide holes 78 and 80 is preferable wider than the space between the lead wires 98 and 100 at the base of the LED element 26 or the base mounting space. In inserting the lead wires 98 and 100 in the holes 78 and 80, the lead wires 98 and 100 are spread out, and brought into secure contact with the coil springs 94 and 96, respectively. Conductive metal movable connecting bars 102 and 104 are disposed between each set of legs 90 and 92 extending from the other end of the spring holder 76. The movable connecting bars 102 and 104 are attached to the respective other ends of the coil springs 94 and 96, having their tip ends received by the recesses 32 and 34 on the other ends of the terminals 28 and 30 and brought in contact with these other ends of the terminals 28 and 30, respectively. Since the bars 102 and 104 are spring-biased, they are pushed against and securely electrically connected with the terminals 28 and 30, respectively. Disposed between the movable connecting bars 102 and 104 is the stopper 56 formed inside the hole 52, each of the bars being located between each set of legs 90 and 92. Therefore, when the rockable member 36 is rocked through a predetermined angle, the positions of the movable connecting bars 102 and 104 are held by the stopper 56 and the legs 90 and 92, whereby the tip ends of the bars 102 and 104 are prevented from leaving the other ends of the terminals 28 and 30, respectively. With their respective tip ends substantially in alignment with the central axis of rocking of the rockable member 36, the movable connecting bars 102 and 104 will be shifted only by a negligible distance if the rockable member 36 is turned.

Figure 6:
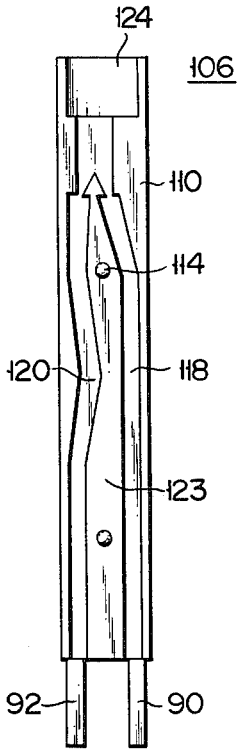
FIGS. 6 and 7 are respective front views of two holder units to form a spring holder fitted in a knob of the toggle switch as shown in FIG. 1.
Figure 7:
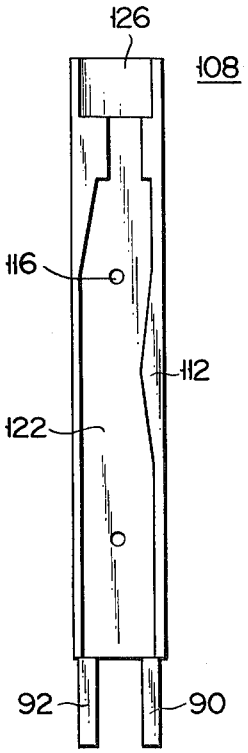
Figure 8:
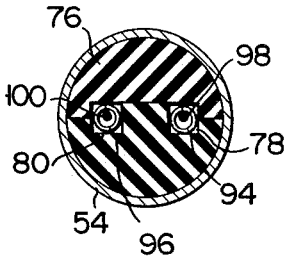
FIG. 8 is a sectional view as taken along line VIII—VIII of FIG. 1.

As shown in FIGS. 6 and 7, the spring holder 76 fitted in the knob 54 is prepared in the form of two holder units 106 and 108 for the ease of manufacture. In order to join these units, the two holder units 106 and 108 are provided with projections 114 and recesses 116 to be fitted therein, respectively. One holder unit 106 is provided with two grooves 118 and 120, while the other holder unit 108 has a relatively wide groove 122. The holder unit 106 has a segment 123 protruding above other contact surfaces between the grooves 118 and 120. When the two holder units 106 and 108 are joined togerther, the segment 123 is stuck fast to the groove 122 of ther holder unit 108. The holder units 106 and 108 are further provided with semicircular portions 124 and 126 to form the recess 82 for receiving the base of the LED element 26 when assembled, spring stoppers 86 and 88, and legs 90 and 92, respectively.

As shown in FIGS. 1, 2 and 5, the frame 70 is provided with a panel mounting portion 128 which extends along planes including the sides of the case 2 and is bent. Mounted on the panel mounting portion 128 is a panel 130 as illustrated. Bored through the panel 130 is a substantially rectangular window 132, through which the top portion of the sector section 40 of the rockable member 36 and the knob 54 are exposed.

In the aforementioned toggle switch, the rockable member 36 will be turned around the projections 48 pivotally supported by the support lugs 72 when the knob 54 is inclined to one side. Then, the bottom end portion of the sector section 40 of the rockable member 36 hits against the flange portion 74 of the frame 70, whereby the rocking angle of the rockable member 36 may be restricted within a fixed range. Each block section 38 is inclined with the rocking motion of the rockable member 36, so that the sliding rod 68 held by the block section 38 moves on the movable contact 25 while being spring-biased, causing the movable contact 25 to make a seesaw motion about the common terminal 24. The seesaw motion of the movable contact 25 switches the switching terminals 20 and 22 to be connected with the common terminal 24 from one to the other. In this switching operation, the connecting bars 102 and 104 move but a little within the recesses 32 and 34 of the terminals 28 and 30, being always in electrical contact with the terminals 28 and 30. Further, the coil springs 94 and 96 connected with the connecting bars 102 and 104 are brought in contact with their corresponding lead wires 98 and 100 at varied portions, securing the electrical contact with the lead wires. Accordingly, in such switching operation, the LED element 26 is securely supplied with electric power for light emission so long as the terminals 28 and 30 are supplied with power.

Since the toggle switch of this invention, as described above, includes neither conductive wires for electrically connecting the lead wires 98 and 100 of the LED element 26 with the terminals 28 and 30 fixed to the case 2, nor soldered joints, the switch itself may be made compact, the electrical connection will not be broken by any mechanical motion, and the assembly may be facilitated.

Figure 9:
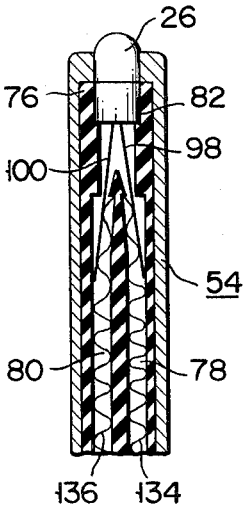
FIG. 9 is a partial sectional view of a knob with an internal construction different from that of the knob of the toggle switch as shown in FIG. 1.

As an alternative example of the aforementioned embodiment of the toggle switch, wavelike leaf springs 134 and 136 may be contained respectively in the guide holes 78 and 80 of the spring holder 76, as shown in FIG. 9, instead of using the coil springs 94 and 96. Like the coil springs 94 and 96, the wavelike leaf springs 134 and 136 are brought in contact with the lead wires 98 and 100 of the LED element 26 at many places to secure good electrical connection therewith.

Meanwhile, the movable connecting bars 102 and 104 are not necessarily required, and the coil springs 94 and 96 may be brought in direct contact with their corresponding terminals 28 and 30 for electrical connection.

Although the rockable member 36 is rockably supported by the case 2 with the projections 48 pivotally supported by the support lugs 72 of the frame 70, the rockable member 36 may be provided, instead of the projections 48, with a shaft which is supported by a bearing member on the case 2, thereby rockably mounting the rockable member 36 on the case 2.

Figure 10:
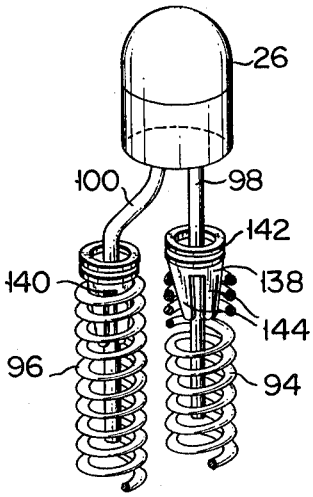
FIG. 10 is a perspective view illustrating connecting member used for connecting lead wires of an LED element with coil springs.

Further, as shown in FIG. 10, the lead wires 98 and 100 of the LED element 26 may be fitted with connecting members 138 and 140, respectively, through which the lead wires 98 and 100 are electrically connected with the coil springs 94 and 96. Each of the connecting members 138 and 140 includes a split conical member 144 which is formed integrally with a ring 142 and squeezed by an external pressure. These connecting members 138 and 140 may securely be electrically connected with the lead wires 98 and 100, respectively, by inserting their respective split conical members 144 into the coil springs 94 and 96 and then inserting the lead wires through their respective rings 142. When a biasing force from the coil springs 94 and 96 is applied to the split conical members 144, the split conical members 144 are squeezed to hold the lead wires 98 and 100, respectively.

Furthermore, the LED element may be provided with three lead wires though the LED element 26 according to the aforesaid embodiment has been described as having two lead wires 98 and 100. In this case, there should be effected proper modifications easily concieved of from this invention by one skilled in the art, such as three terminals fixed to the case 2 and three spring coil guide holes in the holder, each instead of two.

Thus, according to this invention, there may be provided a compact toggle switch with an LED element attached to the knob end, fit for mass production.

What is claimed is:

1. A toggle switch, comprising:

a light emitting diode element having at least two lead wires for power supply and provided with a base from which said lead wires are extended and a light emitting portion attached to said base;

a cylindrical knob receiving the base of said light emitting diode element, the light emitting portion of said light emitting diode element being exposed through one end of said knob;

an elongated electrically insulating spring holder having at least two long and narrow holes extending along the axial direction thereof and into which the lead wires of said light emitting diode elements are separately inserted through one-end openings thereof, and spring stoppers formed in each said hole in close vicinity to said one-end openings, and fitted in said knob;

conductive metal spring members contained in each said hole of the spring holder, having one end brought in contact with each said spring stopper, and being in contact at a plurality of portions with the lead wires inserted in each said hole;

a rockable member fitted with the other end of said knob and capable of being rocked within a predetermined angle by operating said knob;

a case for rockably supporting said rockable member;

a common terminal and two switching terminals made of a conductive metal, fixed to said case, and extending out from said case;

a conductive metal movable contact mounted on the ends of said terminals inside said case and being always in contact with said common terminal as well as with either of said two switching terminals;

a spring-biased rod with one end held by said rockable member and the other end spring-biased to bear against said movable contact, said other end sliding on said movable contact in response to a turn of said rockable member to switch said movable contact from one switching terminal to the other switching terminal; and at least two conductive metal power supply terminals fixed to said case and each having one end substantially in alignment with the center of rocking of said rockable member inside said case, located in close vicinity to the other-end opening of each hole of said holder, and electrically connected with the other end of each spring member contained in said hole, and the other end of each power supply terminal extending outside said case.

2. A toggle switch according to claim 1 further comprising conductive metal connecting bars each attached to the other end of each said spring member, each said connecting bar being spring-biased to bear against one end of each said power supply terminal, whereby said spring member is electrically connected with said power supply terminal substantially at the center of rocking of said rockable member.

3. A toggle switch according to claim 1, wherein the other end of said spring member is held directly against and electrically connected with one end of said power supply terminal.

4. A toggle switch according to claim 1, wherein the space between the one-end openings of the holes of said spring holder into which the lead wires are separately inserted is wider than the space of said lead wires at the base portion of said light emitting diode.

5. A toggle switch according to claim 1, wherein at least one of said two holes of said spring holder is curved, the lead wire inserted in said curved hole being in multipoint contact therewith.

6. A toggle switch according to claim 1, wherein each said spring member is a coil spring.

7. A toggle switch according to claim 1, wherein each said spring member is a wavelike leaf spring.

8. A toggle switch, comprising:

a light emitting diode element having at least two lead wires for power supply and provided with a base from which said lead wires are extended and a light emitting portion attached to said base;

a cylindrical knob receiving the base of said light emitting diode element, the light emitting portion of said light emitting diode element being exposed through one end of said knob;

an elongated electrically insulating spring holder having at least two long and narrow holes extending along the axial direction thereof and into which the lead wires of said light emitting diode element are separately inserted through one-end openings thereof, and stoppers formed in each said hole in close vicinity to said one-end openings, and fitted in said knob;

conductive metal spring members contained in each said hole of the spring holder;

electrically conductive connecting members, each attached to one end of a respective spring member and engaging a stopper in a respective hole of said spring holder, each said connecting member being mounted so as to be biased by its respective spring member against the respective lead wire inserted in each corresponding hole of said spring holder;

a rockable member fitted with the other end of said knob and capable of being rocked within a predetermined angle by opertating said knob;

a case for rockably supporting said rockable member;

a common terminal and two switching terminals made of a conductive metal, fixed to said case, and extending out from said case;

a conductive metal movable contact mounted on the ends of said terminals inside said case and being always in contact with said common terminal as well as with either of said two switching terminals;

a spring-biased rod with one end held by said rockable member and the other end spring-biased to bear against said movable contact, said other end sliding on said movable contact in response to a turn of said rockable member to switch said movable contact from one switching terminal to the other switching terminal; and at least two conductive metal power supply terminals fixed to said case and each having one end substantially in alignment with the center of rocking of said rockable member inside said case, located in close vicinity to the other-end opening of each hole of said holder, and electrically connected with the other end of each spring member contained in said hole, and the other end of each power supply terminal extending outside said case.

* * * * *